United States Patent [19]

Dvorak et al.

[11] Patent Number: 4,907,481

[45] Date of Patent: Mar. 13, 1990

[54] POWERED PRESS WITH MANUAL PUNCH AND DIE ALIGNMENT CAPABILITY

[76] Inventors: Jim Dvorak, P.O. Box 155; Charles J. Dvorak, P.O. Box 67, both of Cosmos, Minn. 56338

[21] Appl. No.: 92,038

[22] Filed: Sep. 2, 1987

[51] Int. Cl.[4] ..... B26F 1/02

[52] U.S. Cl. ..... 83/571; 83/639.1; 83/699; 29/465

[58] Field of Search ..... 83/571, 572, 573, 639, 83/699, 700; 269/75, 136; 29/465; 33/642, 645, 644, 627

[56] References Cited

U.S. PATENT DOCUMENTS

| | | | |
|---|---|---|---|
| 207,619 | 9/1878 | O'Neill | 83/573 |
| 779,387 | 1/1905 | Wunderlich | 83/571 |
| 825,074 | 7/1906 | Richardson | 83/573 |
| 957,914 | 5/1910 | Thompson | 83/573 |
| 1,025,527 | 2/1913 | Stimpson | 83/571 |
| 1,277,469 | 9/1918 | Pater | 83/572 |
| 1,650,411 | 11/1927 | Yates | 83/572 |
| 2,088,202 | 7/1937 | Gray | 83/573 |
| 3,137,193 | 6/1964 | Whistler, Sr. et al. | 33/627 |
| 3,421,226 | 1/1969 | Lauzon | 33/642 |

*Primary Examiner*—Frank T. Yost
*Assistant Examiner*—Scott A. Smith
*Attorney, Agent, or Firm*—Peterson, Wicks, Nemer & Kamrath

[57] ABSTRACT

A latch mechanism in one position causes a ram and the punch mounted thereon to be forcefully actuated in unison with the pivotal arm constituting part of the drive means. In a second position of the latch mechanism, the ram, together with the punch, can be manually lowered without being powered so that an alignment of the die with the punch can be achieved before performing a powered punching operation.

7 Claims, 4 Drawing Sheets

POWERED PRESS WITH MANUAL PUNCH AND DIE ALIGNMENT CAPABILITY

BACKGROUND OF THE INVENTION

1. Field of the Invention

This invention relates generally to powered punch presses, and pertains more particularly to such a press in which the ram having the punch mounted thereon can be unlatched from the power drive so as to enable the operator to manually lower the ram and its punch in order to permit an accurate alignment between the punch and die, doing so before a punching operation is performed.

2. Description of the Prior Art

Metal working apparatus having combined shearing and punching stations has become quite common. However, when a punch press is powered with a hydraulic drive, a severe alignment problem ensues where punch and die sets are frequently changed, for each change requires an accurate alignment of the new female die beneath the new male punch. Any misalignment can cause damage to either the punch or the die, which can be quite costly. If the punch fractures, it can be extremely dangerous to the operator. Therefore, a need has persisted throughout the years for a simple mechanism for enabling the operator to accurately align the punch and die, being able to do so before a powered punching operation is performed.

SUMMARY OF THE INVENTION

Accordingly, an important object of our invention is to permit a manual alignment of the punch and die without lowering the ram and its punch under power. More specifically, an aim of the invention is to provide a latch mechanism that normally connects the ram to the drive system, yet permits the ram to be easily unlatched whenever the punch/die alignment is to be checked or established.

Another object of the invention is to provide a latch mechanism that will be simple and relatively inexpensive, thereby encouraging its addition to various types of powered punch presses. In this regard, it is within the purview of the invention to modify existing machines already in use, although the invention lends itself more readily to being incorporated into original equipment at the factory.

Also, the invention has for an important object the minimizing of punch and die breakage, thereby rendering the apparatus safer and at the same time reducing punch and die breakage costs.

BRIEF DESCRIPTION OF THE DRAWINGS

FIG. 5 is an enlarged sectional view taken in the direction of line 5—5 of FIG. 2 for the purpose of illustrating more clearly the latch mechanism.

DESCRIPTION OF THE PREFERRED EMBODIMENT

Figure 1:
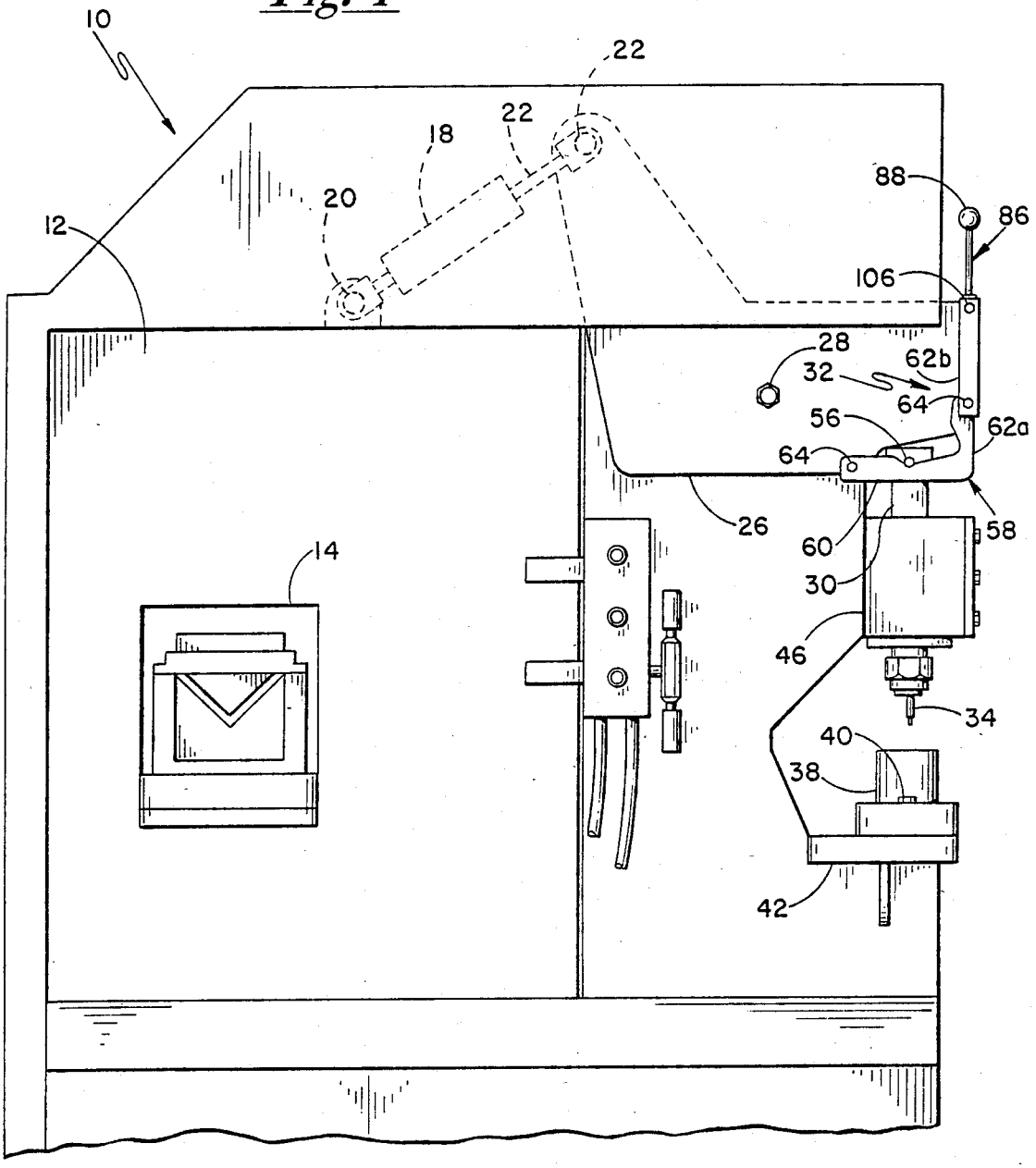
FIG. 1 is a side elevational view of a machine exemplifying our invention, the machine having both a shear station and a punch station.
Figure 2:
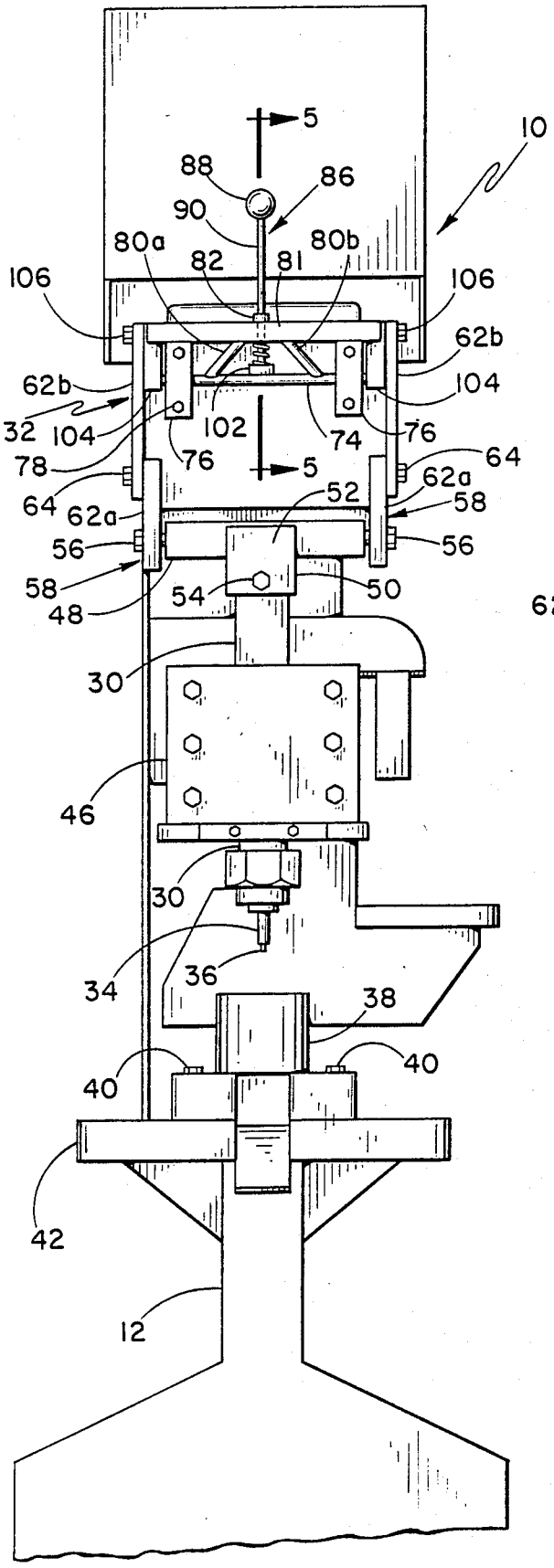
FIG. 2 is an front elevational view with the ram latched to the drive means for powered movement in unison therewith.

Referring first to FIG. 1, the machine there shown has been indicated generally by the reference numeral 10 having a frame 12. Inasmuch as it is customary to combine shearing and press stations in a single machine, the machine 10 includes a shear satiaon at 14 and a punch station 16. However, our invention is not concerned with the shear station 14, so it need not be further described. However, it can be pointed out that the shear station 14 can comprise the shear mechanism disclosed in U.S. Pat. No. 4,054,075, issued on Oct. 18, 1977.

Inasmuch as our invention is susceptible to use with just a punch press without any shearing apparatus associated therewith, the punch station 16 will hereinafter be referred to as a punch press. Since hydraulic drives have become rather widespread, it will be observed that the punch press 16 includes a hydraulic cylinder 18, shown only in phantom outline in FIG. 1, having its closed end pivotally mounted at 20. Projecting from the hydraulic cylinder 18 is a piston rod 22 that has a pivotal connection at 24 with one end of an actuating arm 26 comprised of parallel plate members **26*a*, 26*b* and transverse briding member 26*c* secured to and extending across their foremost ends. The arm 26 is pivotally mounted by reason of a shaft 28 located intermediate its ends, the shaft 28 being anchored to the previously mentioned frame 12**.

A ram 30 is connected to the forward end of the arm 26 by a latch mechanism denoted generally by the reference numeral 32. More will be said hereinafter concerning the construction of the latch mechanism 32. Whereas the latch mechanism 32 provides a releasable connection of the upper end of the ram 30 to the forward end of the arm 26, the lower end of the ram 30 is adapted to hold a male punch 34 having a centering point 36 thereon. The male punch 34 coacts with a female die 38 that is held in place by means of holddown bolts 40 which are threadedly engaged with a bolster plate 42 forming a part of the machine 10, more specifically, part of its frame 12.

The ram 30 in the illustrated instance has a rectangular cross section. The ram 30 is constrained for reciprocal movement along a vertical path provided by guide means indicated generally by the reference numeral 46. It is to be understood that the die 38 consistutes a portion of a punch/die set that is changed from time to time, depending on the size of hole to be punched. It is the die 38 (or a substitute one) that can be shifted so as to provide the needed alignment with the punch 34 (or a substitution) held by the ram 30. It should be recognized at this stage that if the die 38 is not accurately aligned with the particular punch 34 that it is to mate with, then severe damage can occur to the punch 34 and/or die 38. It is also important to recognize that any breakage of thepunch 34 can produce a flying fragment that can be injurious to the oeprator or those in the vicinity of the machine 20. It is the function of the latch mechanism 32 to enable the opertor to lower the ram 30 and its punch 34 manually so that accurate alignment of the die 38 can be made prior to performing any powered punching operation.

It will be observed that the upper end of the ram 30 is fastened to a cross piece or transverse member 48 via a clevis-like clamp 50 comprised of two downwardly extending ears 52 between which the upper end of the ram 30 is disposed. A horizontal bolt 54 extends through the two ears 52 and the upper end of the ram 30. The cross piece or transverse member 48 has oppositely issuing bolts or pins 56 that are cradled by the latch mechanism 32.

The latch mechanism 32 includes two L-shaped members 58, each having a substantially horizontal leg portion 60 and a substantially vertical leg portion 62. The free end of each of the horizontal leg portions 60 is pivotally connected to the free end of the arm 26 by reason of a pivot pin 64 having a hexagonal head, the two pivot pins 64 simply issuing in opposite lateral directions to provide the pivotal mounting of the two L-shaped members 58. It should be noted at this point that the substantially horizontal leg portions 60 each have an upwardly facing shallow notch 66 intermediate its ends. It is in this way that the oppositely issuing bolts or pins 56 on the cross piece 48 are cradled by the L-shaped members 58, more specifically their leg portions 60.

The substantially vertical leg portions 62 are actually composed of two elements, the element which is integral with its particular L-shaped member 58 being labeled **62*a* and the element that, in effect, is an extension of the element 62*a* has been indicated by the numeral 62*b*, in a sense constituting a separate link. A bolt 64 at each side fastens the two elements 62*a* and 62*b* together to form what amounts to the single leg portion 62 of each L-shaped member 58**.

The latch mechanism 32 includes a horizontal shaft 74 journaled in a pair of laterally spaced pillow block bearings 76 that are attached to the transverse member **26*c* of the arm 20 by means of bolts 78. A yoke unit 80 includes a pair of upwardly extending leg portions 80*a* and 80*b* that incline toward each other, the lower ends of these leg portions 80*a* and 80*b* being welded to the shaft 74. A briding or bight portion 80*c* is also included in the yoke unit 80, the opposite ends of the briding portion 80*c* being welded to the upper ends of the leg portions 80*a* and 80*b*. The briding portion 80*c* is in turn welded to the rear side of a transverse strip 81**, the purpose of which will explained hereinafter.

As best understood from FIG. 5, the briding portion **80*c* has flanged bushing 82 extending upwardly therethrough for the reciprocal mounting of a handle unit 86. The handle unit 86 has a knob 88 at its upper end and a shank 90 extending downwardly from the knob 88, the shank 90 being slidable in the bore of the bushing 82. The lower end of the shank 90 has a disc-like head 92 integral therewith, a coil spring 94 contained between the bushing 82 and the head 92 biasing the handle unit 86** downwardly.

Figure 3:
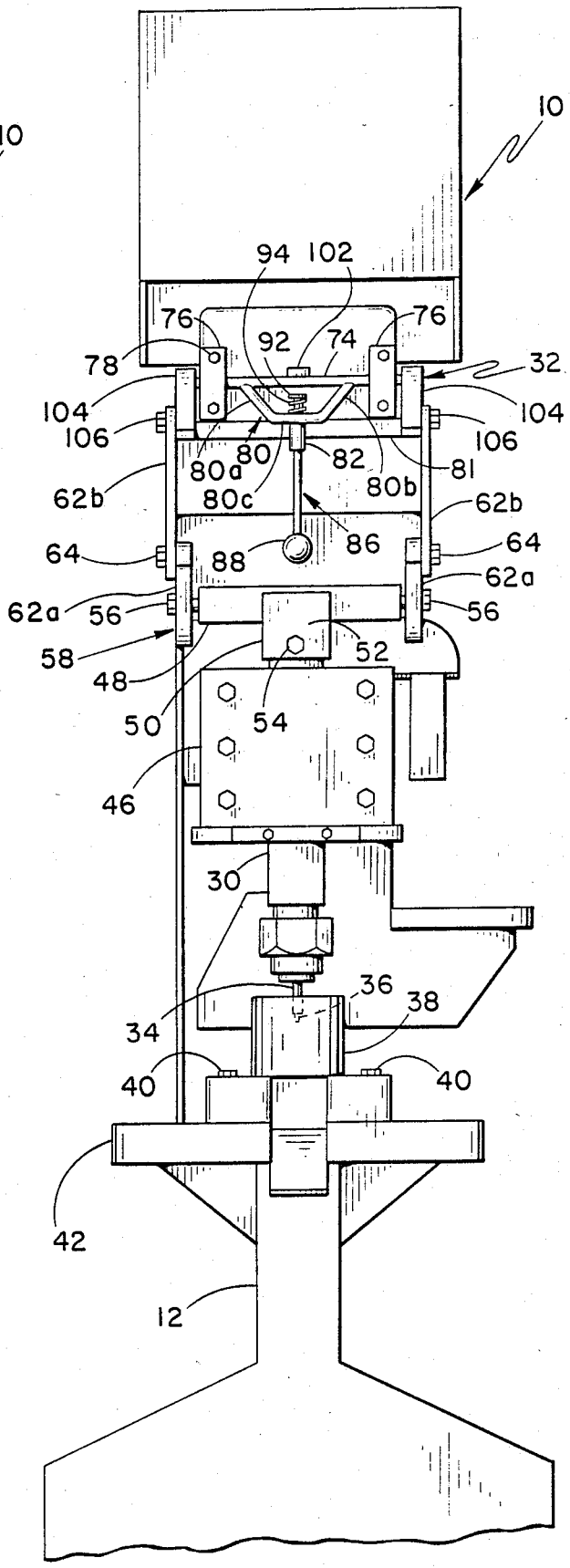
FIG. 3 is a front elevational view corresponding to FIG. 2 but with the ram unlatched and its punch manually lowered so as to enable alignment of the die therewith.
Figure 4:
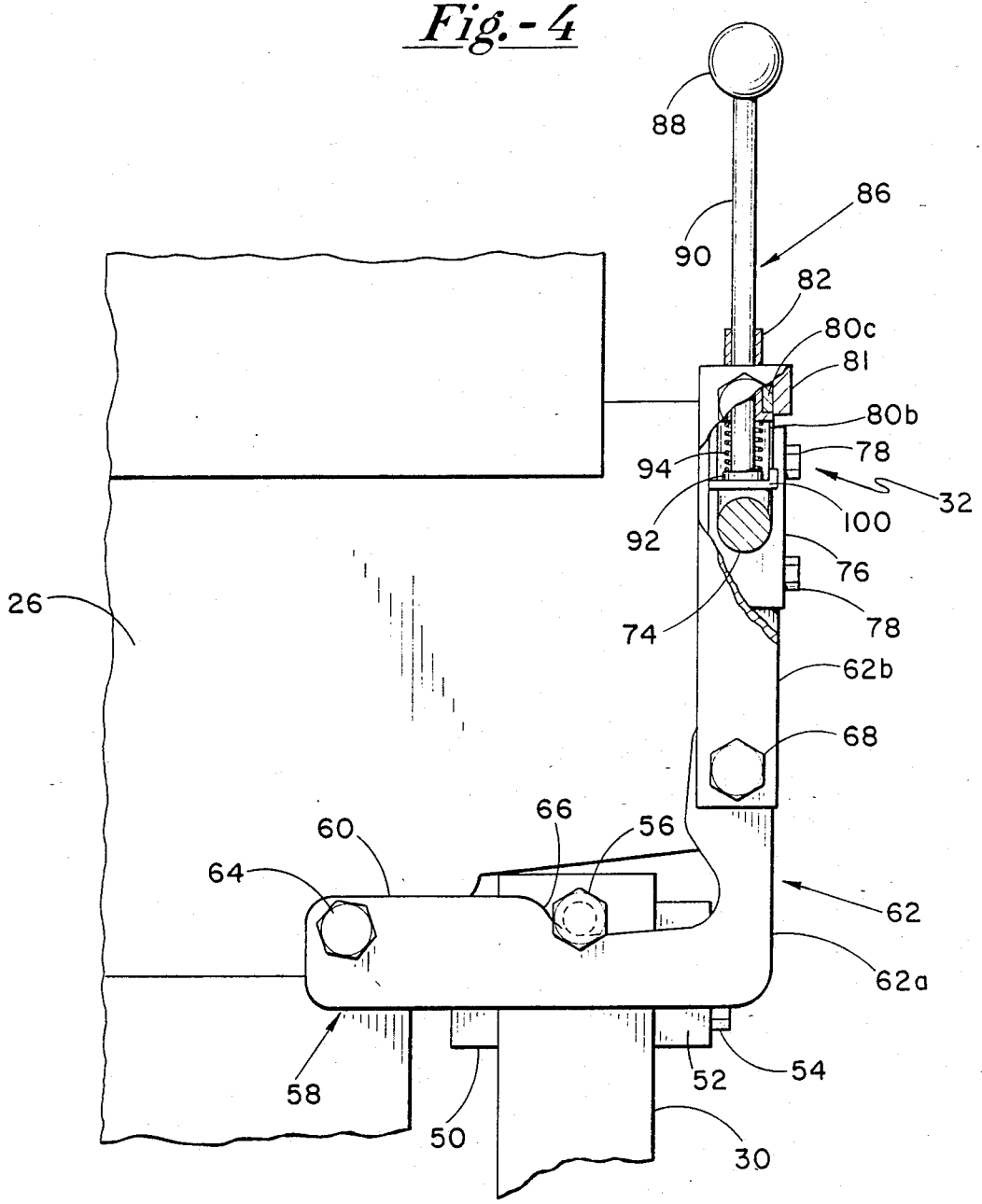
FIG. 4 is a fragmentary side elevational view corresponding to the FIG. 2, a portion thereof being broken away in order to show how the ram is latched, as it is during a powered movement thereof.
Figure 6:
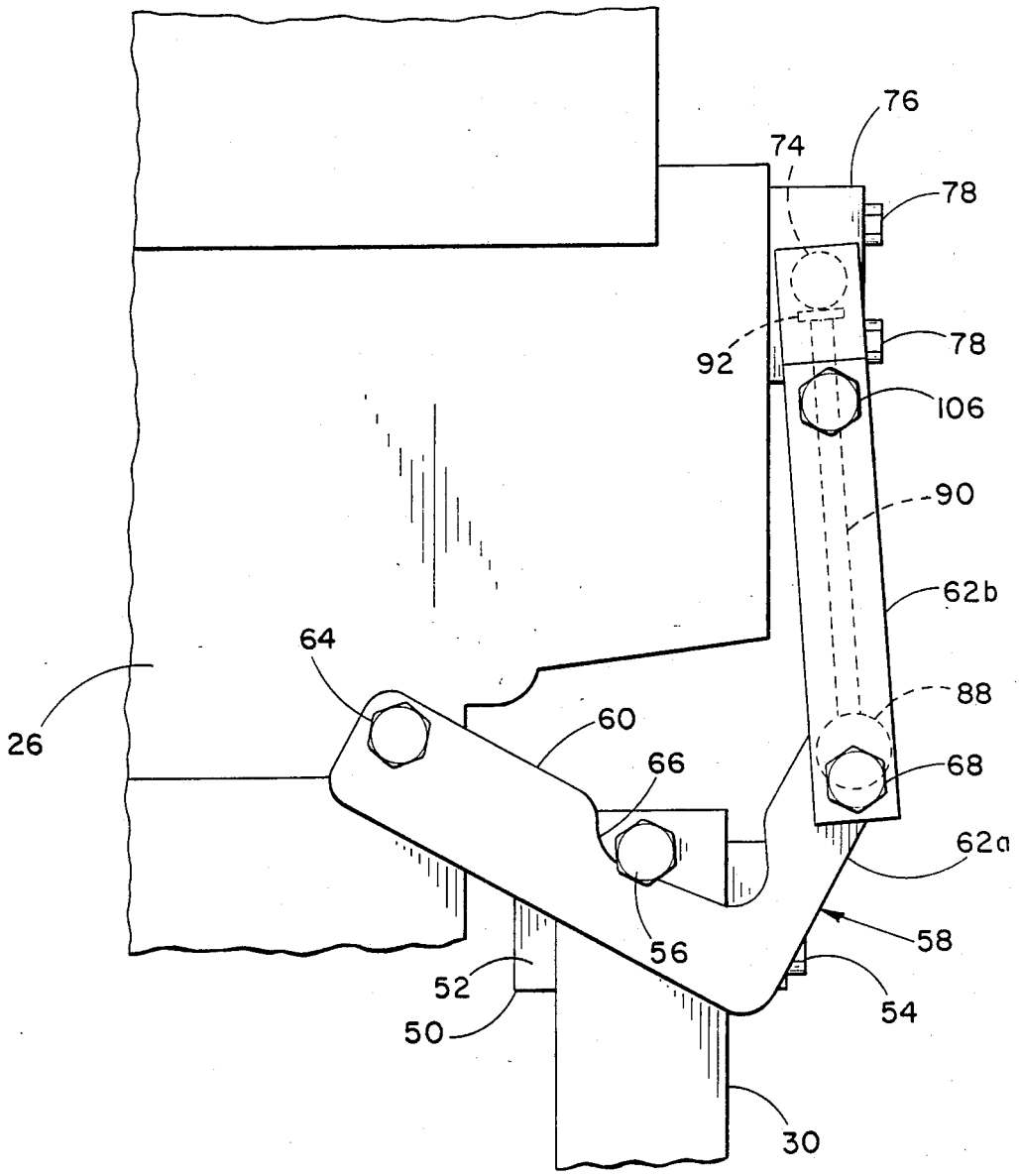
FIG. 6 is a fragmentary side elevational view with the ram unlatched, the view corresponding to FIGS. 3 and 6.

More specifically, the disc-like head 92 is biased downwardly against a forwardly projecting lug or ear 100 that is welded to the transverse plate member **26*c*. The forward end of the lug 100 has an upstadning dog 102 thereon that obstructively prevents the handle unit 86 from being swung from the latched position shown in FIGS. 1, 2, 4 and 5 into the unlatched position illustrated in FIGS. 3 and 6**.

The handle unit 86, of course, is normally biased downwardly by means of the spring 94. However, the handle unit 86 can breadily be raised by simply grapsing the knob 88 and lifting the unit 86 up to move th ehad 92 out of engagement with the dog 102. This enables the operator to swing or pivot the handleunit 86 forwardly from its raised vertical or 12 o'clock position through 90° to the 6 o'clock position appearing in FIGS. 3 and 6.

What can be called short rocker arms 104 have one end in each instance welded to the ends of the shaft 74 and their other ends to the ends of the transverse strip 81. Bolts 106 serve to pivotally connect the ends of the rocker arms 104 (to which the transverse strip 81 is attached) to the upper end of the extensions or links **62*b***.

Having presented the foregoing description, the manner in which any misalignment between the punch 34 and die 38 is corrected should be readily apparent. All that the oprator need do is to attach the appropriat epunch 34 to the lower end of the ram 30. With the bolts 40 that normally anchor the die 38 in place loosened, the operator then simply raises the handle unit 76 so as to disengage the disc-like heda 92 from the dog 102, thus allowing the operator to swing the handle unit 86 from the position in which it appears in FIGS. 1, 2, 4 and 5 to that in which it appears in FIGS. 3 and 6. Such action causes the ram 30 to move gravitationally downwardly in the direction of the die 38, restrained, of course, by the horizontal leg portions of the L-shaped members 58. Usually the ram 30 will be sufficiently heavy so that it does move gravitationally downward. If the ram 30 is relatively lightweight, however, its downward travel may be assisted by providing slots in the leg portions 60 so that a section of end portion 60 overlies its bolt or pin 56, as well as underlying each bolt or pin 56. The ram 30 will in this way be forced downwardly by reason of the manual activation of the handle unit 86. Normally, the ram 30, as just stated, will be sufficiently heavy so that its weight or mass is enough. Therefore, the slotted arrangement is not illustrated. With the holddown bolts 40 loosened, the operator can readily shift the die 38, which is now free to move on the bolster plate 42, relative to the punch 34 so that the lower end of the punch 34 can enter the die cavity, the centering point 36 helping.

Once the above has been accomplished, the operator immediately tightens the holddowns bolts 40 so that the die 38 will not move. Thereafter, the operator swings the handle unit 86 back into its vertical position as shown in FIGS. 1, 2, 4 and 5. The punch press 16 is now in readiness for a powered punching operation. It is when hydraulic fluid enters the cylinder 18 and forces the piston rod 22 outwardly that the arm 26 is pivotaed about its shaft 28 with the consequence that the forward end of the arm 26 acts against the cross piece or transverse member 48, the cross piece or transverse member 48 functioning as sort of an anvil. Since the upper end of the ram 30 is fastened to the cross piece or transverse member 48 by means of the clevis-like clamp 50 and the bolt 54 that extends through the foremost ear 52, the free end ofthe arm 26 acts against the cross piece or transverse member 48 to forcefully move the ram 30 downwardly.

It is the downward movement or stroke of the ram 30 that forces the punch 34 through the sheet stock (not illustrated) that is positioned above the die 38. As long as the punch 34 and die 38, as a set, remain the same, there is usually no need to check the alignment. However, when the punch 34 and die 38 are changed to provide a different size (or shape) hole in the sheet metal stock, then the alignment must be reestablished which the latch mechanism 32 readily permits. Hence, the latch mechanism 32 when in a vertical position connects the ram 30 to the free end of the arm 26 so as to move in unison therewith, and when in a second position the latch mechanism 32 permits the operator to manually lower the ram 30 without any driving force being applied to the ram 30.

We claim:

1. A punch apparatus comprising a ram, means guiding siad ram for reciprocal movement, drive means for powering said ram, a latch mechanism on said drive means for connecting said ram to said drive means in one position thereof so that said ram moves in unison with said drive means to perform a powered punching operation and for disconnecting said ram from said drive means in a second position thereof, sand a handle unit, said latch mechanism including means mounting said handle unit on said latch mechanism for pivotal movement between first and second positions to cause said latch mechanism to move between its said first and second positions when said handle unit is pivoted from its said first position into tis said second position so that said ram can be manually moved by said handle unit relative to said drive means to enable an operator to manually align a die with a punch on said ram and to do so prior to a powered punching operation.

2. Punch apparatus in accordance with claim 1 including a transverse member attached to the upper end of said ram, said transverse member having oppositely issuing pins cradled by said latch mechanism as said handle unit is moved from its said first position to its said second position.

3. Punch apparatus in accordance with claim 2 in which said latch mechanims includes a pair of generally L-shaped members, each having a first substantially horizontal leg and a second substantially vertical leg, and means pivotally connecting the free ends of said first legs to said drive means so that intermediate portions of said first legg underlie and cradle said oppositely issuing pins as said handle unit is moved from its said first position to its said second position.

4. Punch apparatus comprising a ram, a punch carried by said ram, a pivotal arm, means for connecting and disconnecting said ram to said ram, and a handle unit includinga reciprocable shank and means biasing said shank in one direction, said connecting and disconnecting means including a dog engageable by said shank when said shank is biased in said one direction to maintain a connection of said ram to said ram, whereby a die can be aligned with said punch when said shank is disengaged.from said dog and said ram is disconnected from said arm to allow said ram to be manually moved toward said die.

5. Punch apparatus in accordance with claim 5 including power means for pivoting said arm in a direction to cause said punch to engage said die when said shank is engaged with said dog and said arm is connected to said ram.

6. Punch apparatus comprising a ram, means guiding said ram for reciprocal movement, a transverse member attached to the upper end of said ram, said transverse member having oppositely issuing pins, drive means for powering said ram, a manually actuatable latch mechanism on said drive means for connecting said ram to said drive means in one position thereof so that said ram moves in unison with said drive means to perform a powered punching operation and for disconnecting said ram from said drive means in a second position thereof so that said ram can be manually moved relative to said drive means to enable an operator to manually align a die with a punch on said ram and to do so prior to a powered punching operation, said latch mechanism including a pair of generally L-shaped members, each having a first substantially horizontal leg and a second substantially vertical leg, means pivotally connecting the free ends of said first legs to sid drive means so that intermediate portions of said first legs underlie and cradle said oppositely issuing pins and a transverse member extending between the upper ends of said second legs, a handle unit reciprocably mounted on said last-mentioned transverse member so that a first portion of said handle unit extends above said last-mentioned transverse member and a second portion of said handle unit extends below said last-mentioned transverse member, and projecting means on said drive means for engaging the lower end of said handle unit to cause said ram to move in unison with said drive means.

7. Punch apparatus in accordance with claim 6 in which said projecting means includes a lug fixedly anchored to said drive means having a dog at its free end, the lower end of said handle unit being engageable and disengageable with said dog.

* * * * *